US012098514B2

(12) United States Patent
Buchholz et al.

(10) Patent No.: US 12,098,514 B2
(45) Date of Patent: Sep. 24, 2024

(54) SUPPORT SYSTEM FOR HOIST SYSTEM

(71) Applicant: Joy Global Surface Mining Inc, Milwaukee, WI (US)

(72) Inventors: Brent Buchholz, Sussex, WI (US); Joseph James Wirkus, West Bend, WI (US); Jonathan Webster, Franklin, WI (US); Joseph Colwell, Hubertus, WI (US)

(73) Assignee: JOY GLOBAL SURFACE MINING INC, Milwaukee, WI (US)

( * ) Notice: Subject to any disclaimer, the term of this patent is extended or adjusted under 35 U.S.C. 154(b) by 1231 days.

(21) Appl. No.: 16/818,576

(22) Filed: Mar. 13, 2020

(65) Prior Publication Data

US 2020/0290849 A1 Sep. 17, 2020

Related U.S. Application Data

(60) Provisional application No. 62/819,238, filed on Mar. 15, 2019.

(51) Int. Cl.
*E02F 3/43* (2006.01)
*E02F 9/20* (2006.01)

(52) U.S. Cl.
CPC ..... *E02F 3/435* (2013.01); *E02F 9/202* (2013.01)

(58) Field of Classification Search
CPC . E02F 9/202; E02F 3/427; E02F 3/435; E02F 3/308; E02F 3/46; B66D 1/22
USPC ..... 414/680, 709, 710, 722, 723
See application file for complete search history.

(56) References Cited

U.S. PATENT DOCUMENTS

| | | | |
|---|---|---|---|
| 4,509,895 | A | 4/1985 | Baron |
| 9,150,391 | B2 | 10/2015 | Wurster et al. |
| 9,783,958 | B2 | 10/2017 | Dretzka |
| 2013/0093213 | A1 | 4/2013 | Ushiroguchi |

(Continued)

FOREIGN PATENT DOCUMENTS

| | | | |
|---|---|---|---|
| CA | 1129378 | A | 8/1982 |
| CN | 104948675 | A | 9/2015 |
| CN | 206174016 | U | 5/2017 |

(Continued)

OTHER PUBLICATIONS

Chinese Patent Office Action for Application No. 202010176242.1 dated Sep. 16, 2022 (7 pages, including an English statement of relevance).

(Continued)

*Primary Examiner* — Jamie L McGowan
*Assistant Examiner* — Audrey L Lusk
(74) *Attorney, Agent, or Firm* — Husch Blackwell LLP

(57) ABSTRACT

A support system is provided for a gear case of a rope shovel. The gear case supports a gear drive configured to drive rotation of a hoist drum, and the gear case includes a first end, a second end, and a longitudinal axis extending between the first end and the second end. The support system includes: a coupling for securing the gear case against translational movement relative to a rotating frame, the coupling oriented orthogonally to the longitudinal axis and configured to engage the rotating frame and a portion of the gear case; and a support member configured to be coupled to the rotating frame of the rope shovel and supporting the gear case, the support member permitting translational movement of the gear case relative to the rotating frame to accommodate flexing of the rotating frame.

21 Claims, 15 Drawing Sheets

(56) References Cited

U.S. PATENT DOCUMENTS

2014/0037414 A1 2/2014 Hren et al.

FOREIGN PATENT DOCUMENTS

| | | | |
|---|---|---|---|
| CN | 212670679 | U | 3/2021 |
| JP | H10331191 | A | 12/1998 |
| JP | 2005273143 | A | 10/2005 |
| JP | 2017115349 | A | 6/2017 |

OTHER PUBLICATIONS

Chilean Patent Office Action and Search Report for Application No. 202000673 dated Mar. 8, 2021 (16 pages including statement of relevance).

Indian Examination Report for Application No. 202014010802 dated Apr. 28, 2023 (6 pages).

SUPPORT SYSTEM FOR HOIST SYSTEM

REFERENCE TO RELATED APPLICATION

This application claims the benefit of co-pending, prior-filed U.S. Provisional Patent Application No. 62/819,238, filed Mar. 15, 2019, the entire contents of which are incorporated by reference.

FIELD

The present disclosure relates to a hoist system, and more particularly to a support system for a hoist system.

BACKGROUND

A mining rope shovel may include a hoist system for lifting a digging attachment.

SUMMARY

In one independent aspect, a support system is provided for a gear case of a rope shovel. The gear case supports a gear drive configured to drive rotation of a hoist drum, and the gear case includes a first end, a second end, and a longitudinal axis extending between the first end and the second end. The support system includes: a coupling for securing the gear case against translational movement relative to a rotating frame, the coupling oriented orthogonally to the longitudinal axis and configured to engage the rotating frame and a portion of the gear case; and a support member configured to be coupled to the rotating frame of the rope shovel and supporting the gear case, the support member permitting translational movement of the gear case relative to the rotating frame to accommodate flexing of the rotating frame.

In another independent aspect, a support system is provided for a gear case of a rope shovel. The gear case supports a gear drive configured to drive rotation of a hoist drum, and the gear case further including a first end, a second end, and a longitudinal axis extending between the first end and the second end. The support system includes: a first coupling configured to be coupled between a rotating frame of the rope shovel and the first end of the gear case, the first coupling inhibiting movement of the gear case in a direction that is parallel to the longitudinal axis and inhibiting movement of the gear case in a direction that is perpendicular to the longitudinal axis; and a second coupling configured to be coupled between the rotating frame and the second end of the gear case, the second coupling inhibiting movement of the gear case in a direction that is perpendicular to the longitudinal axis while permitting movement of the gear case relative to the rotating frame in a direction parallel to the longitudinal axis to accommodate flexing of the rotating frame.

In yet another independent aspect, a transmission system for driving a hoist drum of a rope shovel includes: a housing having a first end, a second end, and a longitudinal axis extending therebetween; a plurality of gears supported within the housing, the gears transmitting a driving torque to the hoist drum to rotate the hoist drum; and structure for supporting the housing relative to a rotating frame of the rope shovel. The structure includes: a coupling between a rotating frame of the rope shovel and the housing, the coupling inhibiting translational movement of the housing in a direction parallel to the longitudinal axis, and a translating connection engaging a portion of the housing and supporting the housing for translational movement along the longitudinal axis.

Other aspects of the disclosure will become apparent by consideration of the detailed description and accompanying drawings.

BRIEF DESCRIPTION OF THE DRAWINGS

FIG. 14A is a support system for a hoist system gear case according to yet another embodiment, while

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to a support system for a hoist system, e.g., of a rope shovel. The support system assists in evenly distributing loads exerted on the connections between the hoist system gear case and the rotating frame of the shovel, while also permitting movement to accommodate flexing of the rotating frame.

Figure 1:
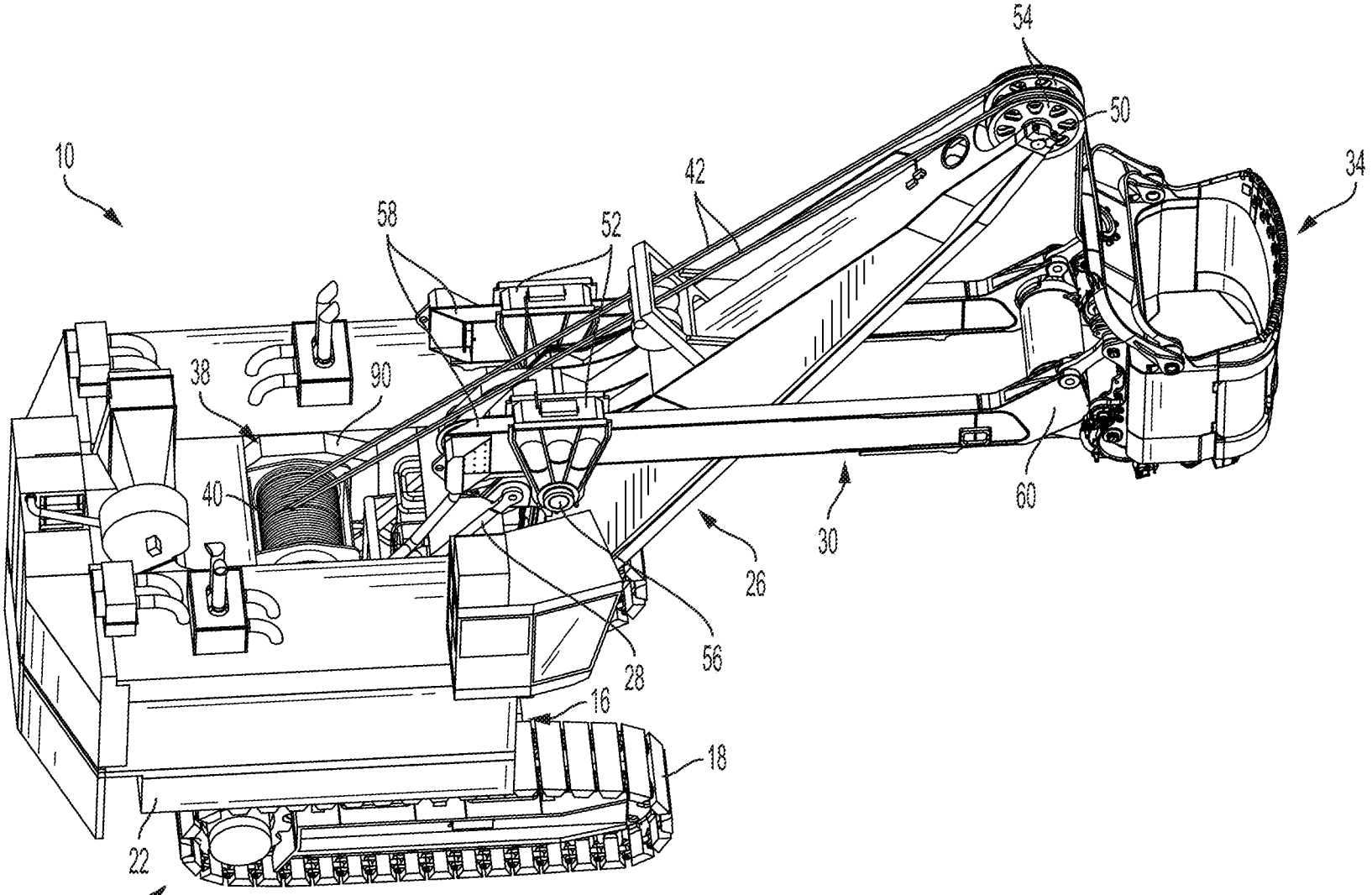
FIG. 1 is a perspective view of a rope shovel.

FIG. 1 illustrates an excavating machine such as a rope shovel 10 including a base 14, a boom 26, an elongated member or handle 30, and a digging attachment or dipper 34. The base 14 includes a lower portion 16 supported by traction elements (e.g., crawlers 18) and an upper portion or rotating frame 22 supported for rotation relative to the lower portion 16 about an axis.

The boom 26 includes a first end coupled to the rotating frame 22, a second end 50 opposite the first end. A boom sheave 54 is supported adjacent the second end 50 of the boom 26. Saddle blocks 52 and a shipper shaft 56 are supported on the boom 26 between the first end and the second end 50. The boom 26 is pivotable relative to the rotating frame 22 about the first end. In the illustrated embodiment, a support member 28 is coupled between the rotating frame 22 and the boom 26 and limits the pivoting movement of the boom 26 relative to the rotating frame 22. In other embodiments, the boom 26 is supported by a gantry or other structure.

The handle 30 is movably coupled to the boom 26 and includes a first end 58 and a second end 60. In the illustrated embodiment, the handle 30 is supported for translational and rotational movement relative to the boom 26 by the shipper shaft 56 and the saddle blocks 52. In the illustrated embodiment, the dipper 34 is fixed to the second end 60 of the handle 30. In other embodiments, the machine 10 includes a bucket that is pivotable relative to the handle 30 about the second end 60. In other embodiments, the handle may be constructed in a different manner and/or may be supported with respect to the boom in a different manner. For example, the handle may be a telescoping member that is pivotally connected to the boom by a yoke, and the handle may be driven to extend and retract by actuation of one or more fluid cylinders.

The shovel 10 further includes a hoist system 38 supported on the rotating frame 22 for reeling in and paying out a hoist rope or cable 42. The hoist system 38 includes a drum 40 about which a portion of the cable 42 is wrapped. The cable 42 is secured between the drum 40 and the dipper 34, passing over the boom sheave 54. The dipper 34 is raised or lowered relative to the boom sheave 54 as the cable 42 is reeled in or paid out, respectively.

Figure 3:
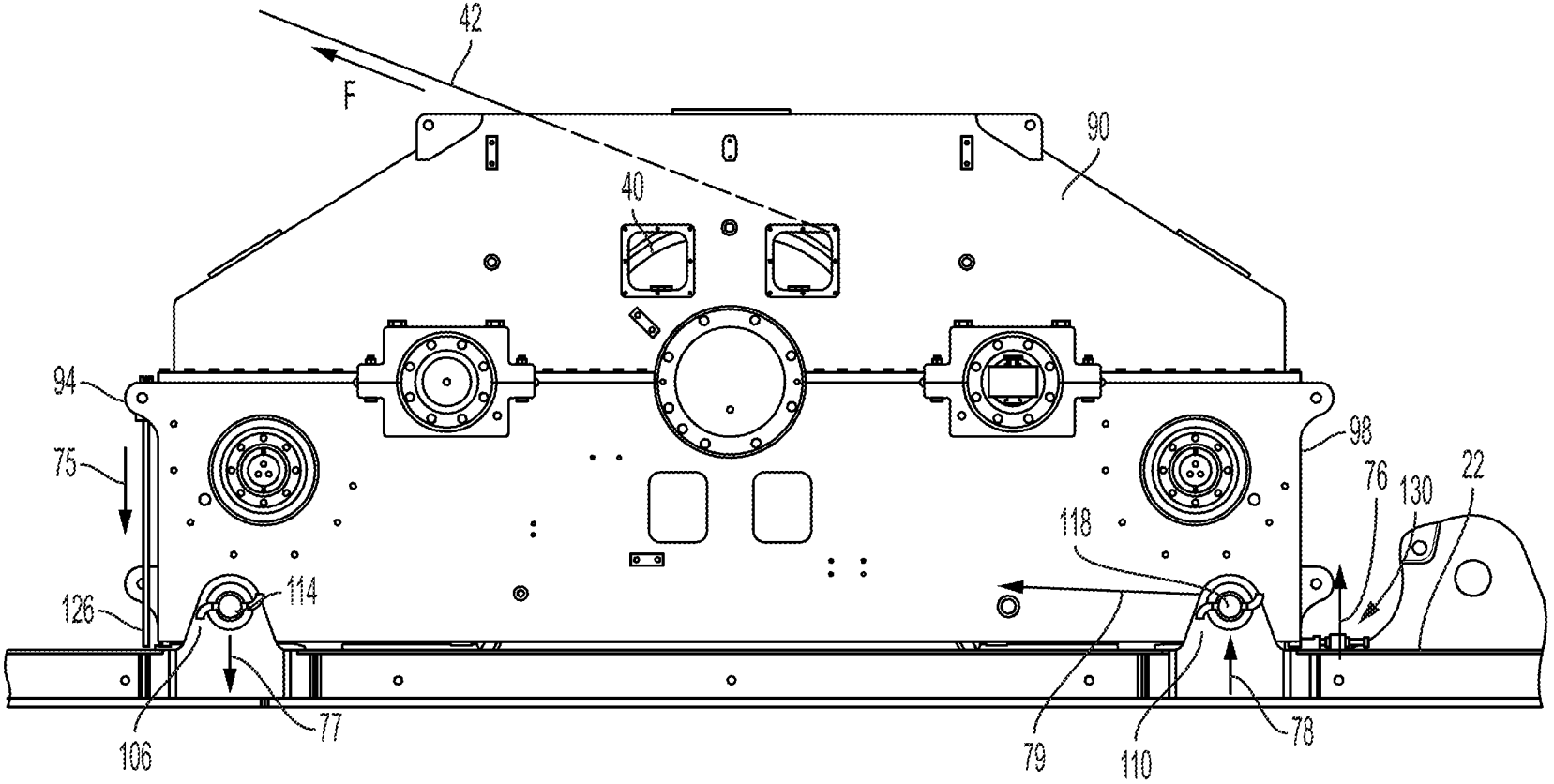
FIG. 3 is a side view of a support system for a hoist system gear case according to another embodiment.

The hoist drive system 38 includes one or more gears that form a gear drive or transmission for driving the drum 40 to take in or let out the cable 42. As shown in FIG. 3, in the illustrated embodiment, the transmission is supported within a housing of a gear case 90 positioned adjacent an end of the drum 40. The gear case 90 is supported on the rotating frame 22. The gear case 90 includes a first end 94 and a second end 98. In the illustrated embodiment, the first end 94 is positioned proximate the front end of the rotating frame 22 (i.e., proximate the boom 26—FIG. 1), while the second end 98 is positioned toward a rear end of the rotating frame 22 (i.e., on a side opposite the boom 26). A tensile force or hoist force F (FIG. 3) is exerted in the cable 42, which extends from the drum 40 to the boom sheave 54 (FIG. 1).

Figure 2:
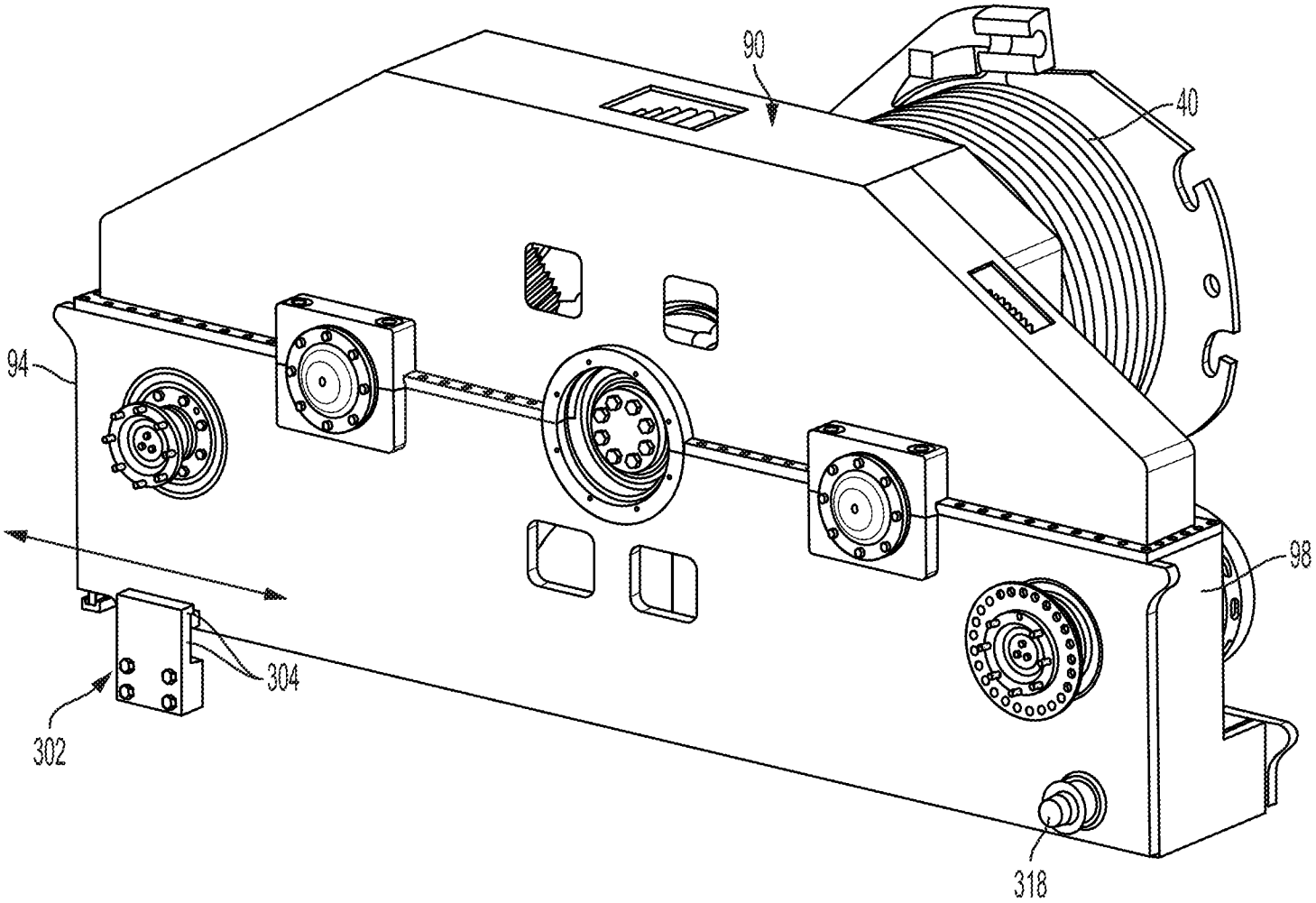
FIG. 2 is a support system for a hoist system gear case for the rope shovel of FIG. 1.

FIG. 2 illustrates a system for supporting the gear case 90 according to an embodiment. The gear case 90 is coupled to the rotating frame (not shown) by a pin 318 adjacent the second end 98. The first end 94, on the other hand, is not pinned to the rotating frame 22 but rather is permitted to slide in a direction parallel to a longitudinal axis of the gear case 90 extending between the first end 94 and the second end 98 (e.g., in a forward and rearward direction). In the illustrated embodiment, the first end 94 is supported for sliding movement by a pad (not shown) formed from a dissimilar material. In addition, a retainer 302 includes horizontal stop surfaces 304 to inhibit lateral movement and/or twisting of the gear case 90. In some embodiments, the retainer 302 may include vertical stop surfaces to inhibit the gear case 90 from lifting away from the rotating frame 22.

Figure 4:
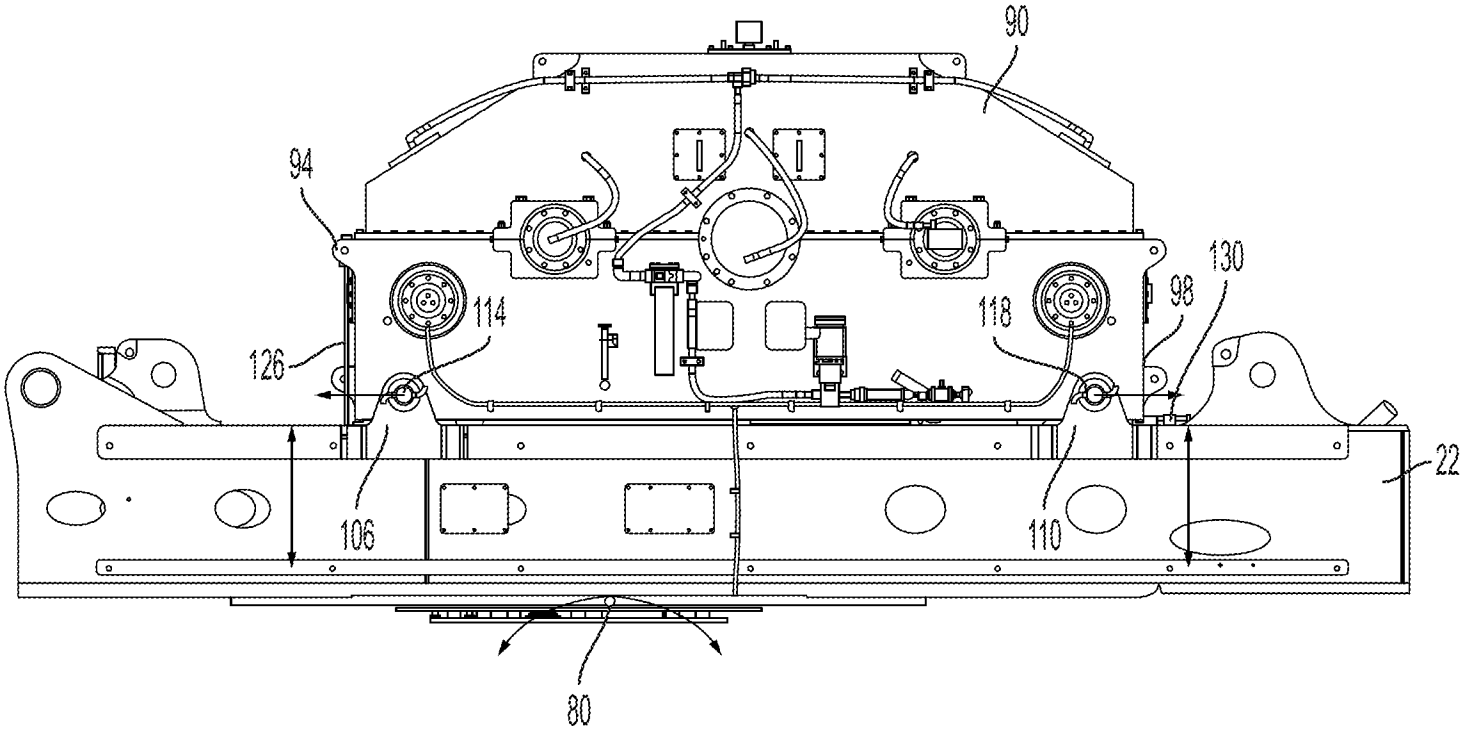
FIG. 4 is a side view of the gear case of FIG. 3.
Figure 5:
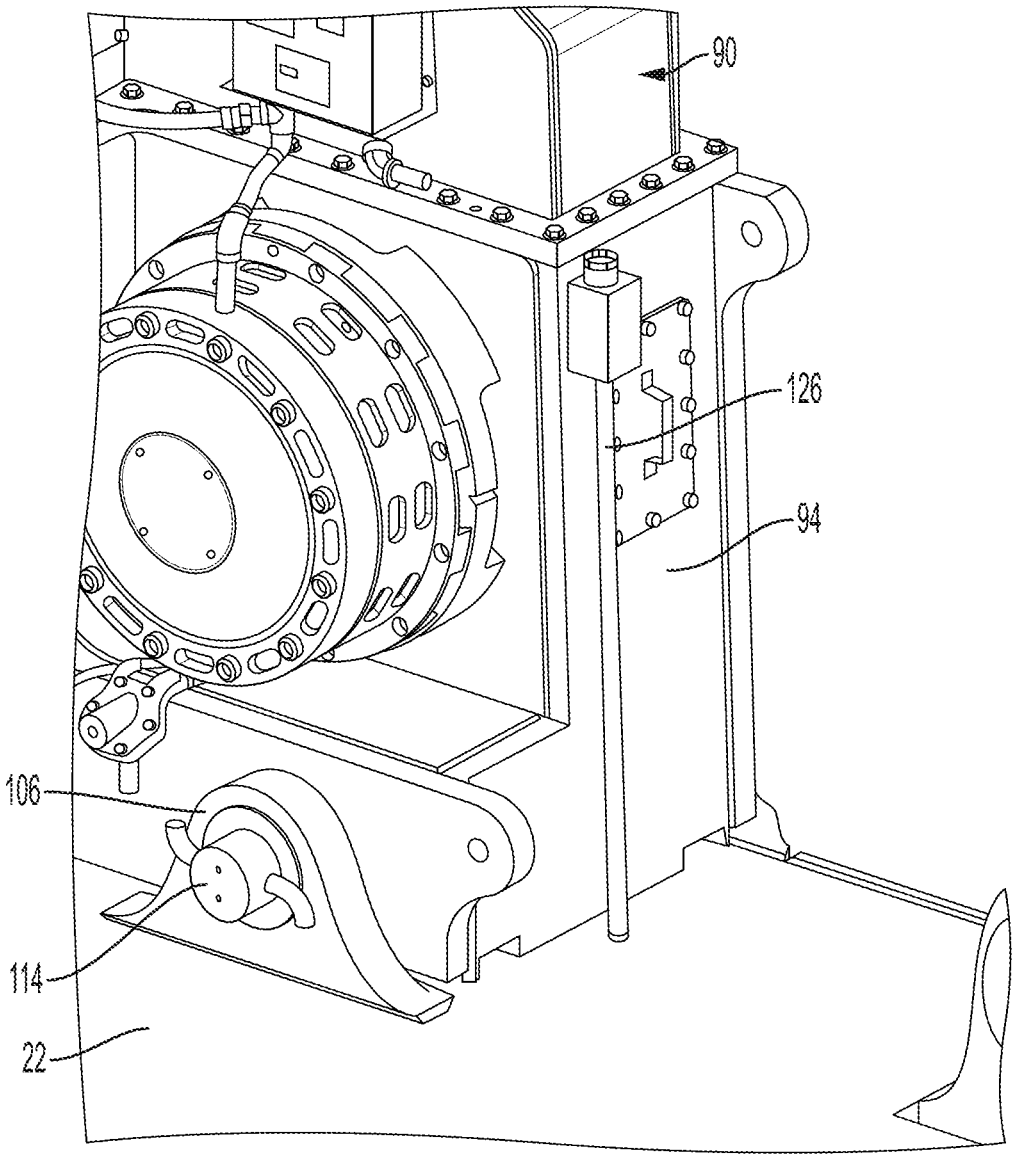
FIG. 5 is a perspective view of a portion of the gear case of FIG. 3
Figure 6:
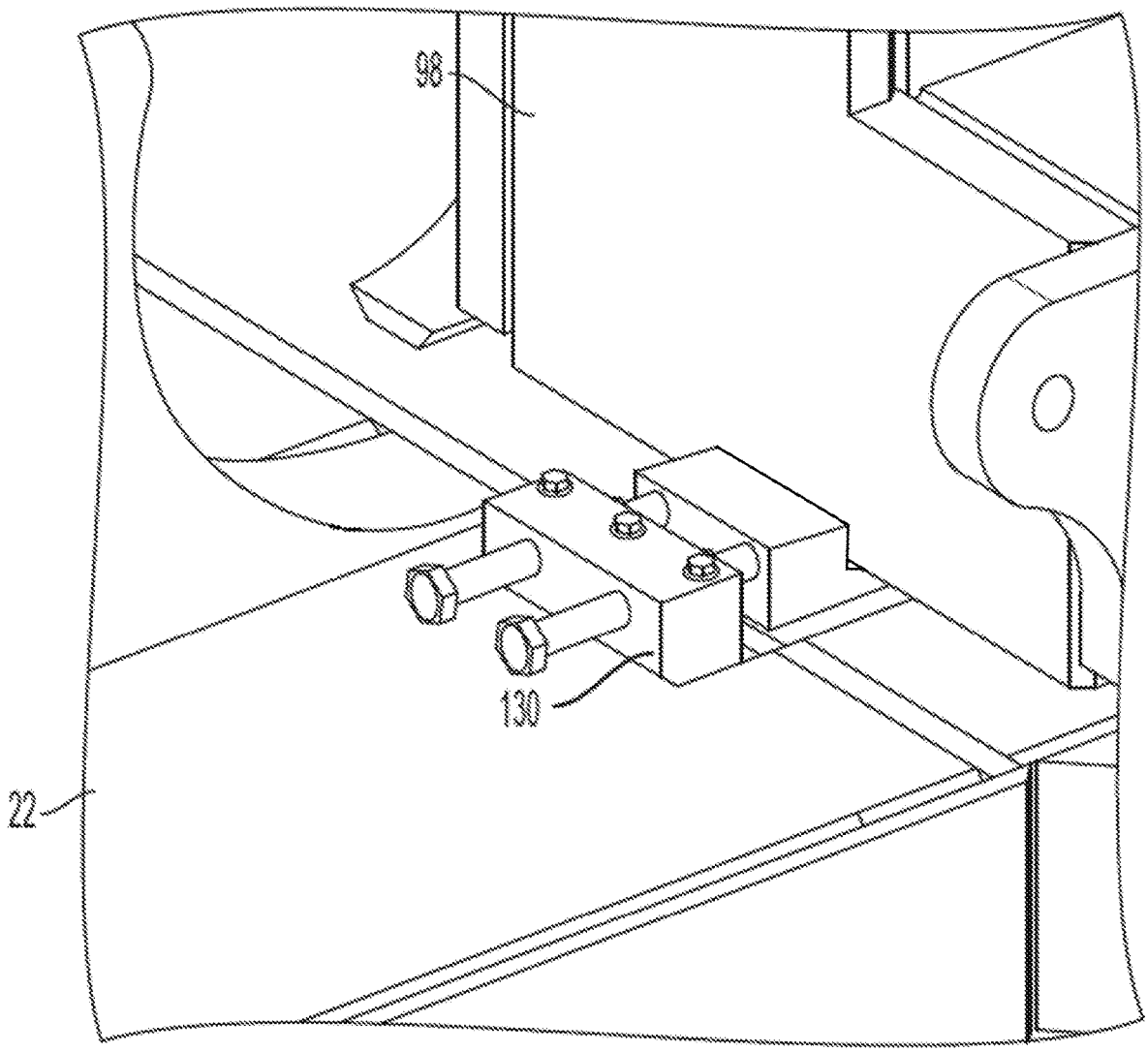
FIG. 6 is another perspective view of another portion of the gear case of FIG. 3.

As shown in FIGS. 3 and 4, in another embodiment of a system for supporting a gear case 90 the rotating frame 22 includes a first lug 106 and a second lug 110. A first pin 114 extends through the first lug 106 and through the gear case 90 proximate the first end 94. Similarly, a second pin 118 extends through the second lug 110 and through the gear case 90 proximate the second end 98. In addition, as shown in FIG. 5, a tensioning member (e.g., a rod bolt 126) is positioned adjacent to the first end 94 and is coupled between the gear case 90 and the rotating frame 22. The bolt 126 applies a clamping force 75 in a direction substantially normal to the rotating frame 22 (i.e., vertically) and biases the first end 94 of the gear case 90 toward the rotating frame 22. Also, as shown in FIG. 6, a wedge 130 is positioned adjacent the second end 98, between the gear case 90 and the rotating frame 22, and biases the second end 98 of the gear case 90 away from the rotating frame 22. In the illustrated embodiment, the wedge 130 is a threaded pin wedge block.

During operation of the shovel 10, the rotating frame 22 can flex and alter a distance between the first lug 106 and the second lug 110. For example, the rotating frame 22 may be subjected to a bending load condition that causes the rotating frame 22 to flex about a flexure point 80 (FIG. 4). The gear case 90 and/or the rotating frame 22 lugs 106, 110 provide a clearance fit with the first pin 114 and/or the second pin 118 to accommodate the movement of the lugs 106, 110. The clearance fit may, for example, ease the assembly of the rotating frame 22, lugs 106, 110, and gear case 90. In some embodiments, the clearance around the first pin 114 is greater than the maximum deflection of the lugs 106, 110. In some embodiments, the total clearance around the pins 114, 118 is greater than the maximum deflection of the lugs 106, 110, and the clearance around the first pin 114 is larger than the clearance around the second pin 118. In some embodiments, the total clearance is less than the maximum deflection but sufficient to significantly reduce the lateral load transfer through the pin connections caused by deflection of the rotating frame 22.

The clamp force 75 exerted by the bolt 126 biases the gear case 90 and the first pin 114 toward the lower surface of the first lug 106, while the wedge 130 biases the gear case and second pin 118 toward the upper surface of the second lug 110 as shown in FIG. 3 by wedge force 76. As a result, the bolt 126 and the wedge 130 maintain a substantially uniform load flow through the pin connections 114, 118 even when the rotating frame 22 is subject to flexing. Stated another way, the hoist force F results in a first force 77 (FIG. 3) exerted toward the rotating frame 22 at the first lug 106 (e.g., a forward lug), and a second force 78 exerted away from the rotating frame 22 at the second lug 110 (e.g., the rearward lug). A third force 79 is oriented in a direction from the second lug 110 to the first lug 106. The bolt 126 provides clamping force 75, which acts to pre-load the first pin 114 at the first lug 106, and the wedge 130 acting with the wedge force 76 acts to pre-load the second pin 118 at the second lug 110. The pre-load forces assist in maintaining a substantially uniform load at the pin connections 114, 118. The clamping force 75 exerted by the bolt 126 also biases the first pin 114 tightly against the gear case 90 to reduce vibrations that may occur during operation (i.e., the bolt 126 removes the clearance between the first pin 114 and the gear case 90). In addition, horizontal or transverse loads such as the third force 79 can be accommodated by the sides of the lugs 106, 110. The allowable deformation or stretch of the bolt 126 is greater than the deflection of the rotating frame 22 in order to avoid yielding of the bolt 126 or loss of clamp load.

Figure 7A:
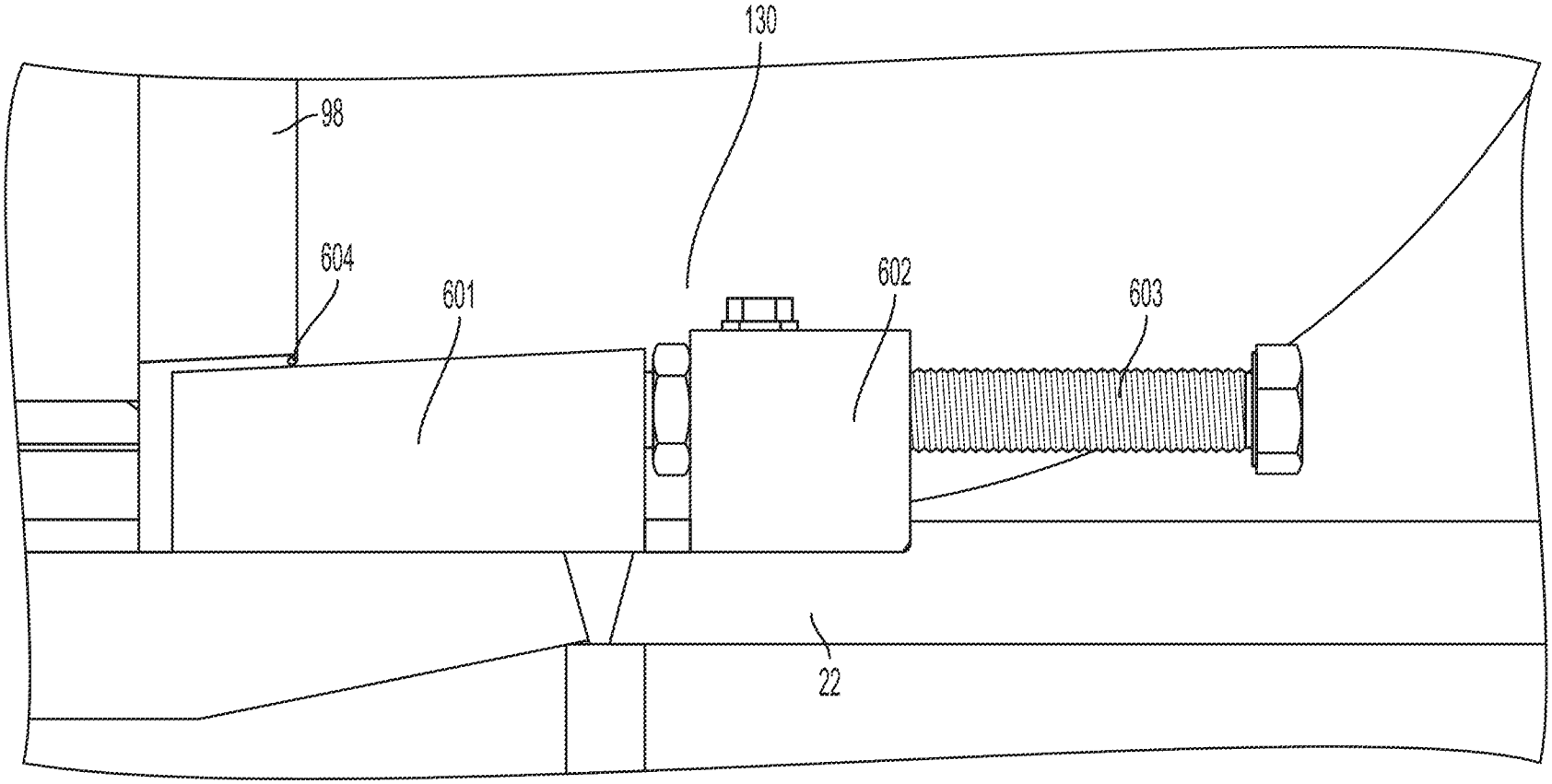
FIGS. 7A and 7B illustrate two cross-sectional views of the portion of the gear case of FIG. 6.
Figure 7B:
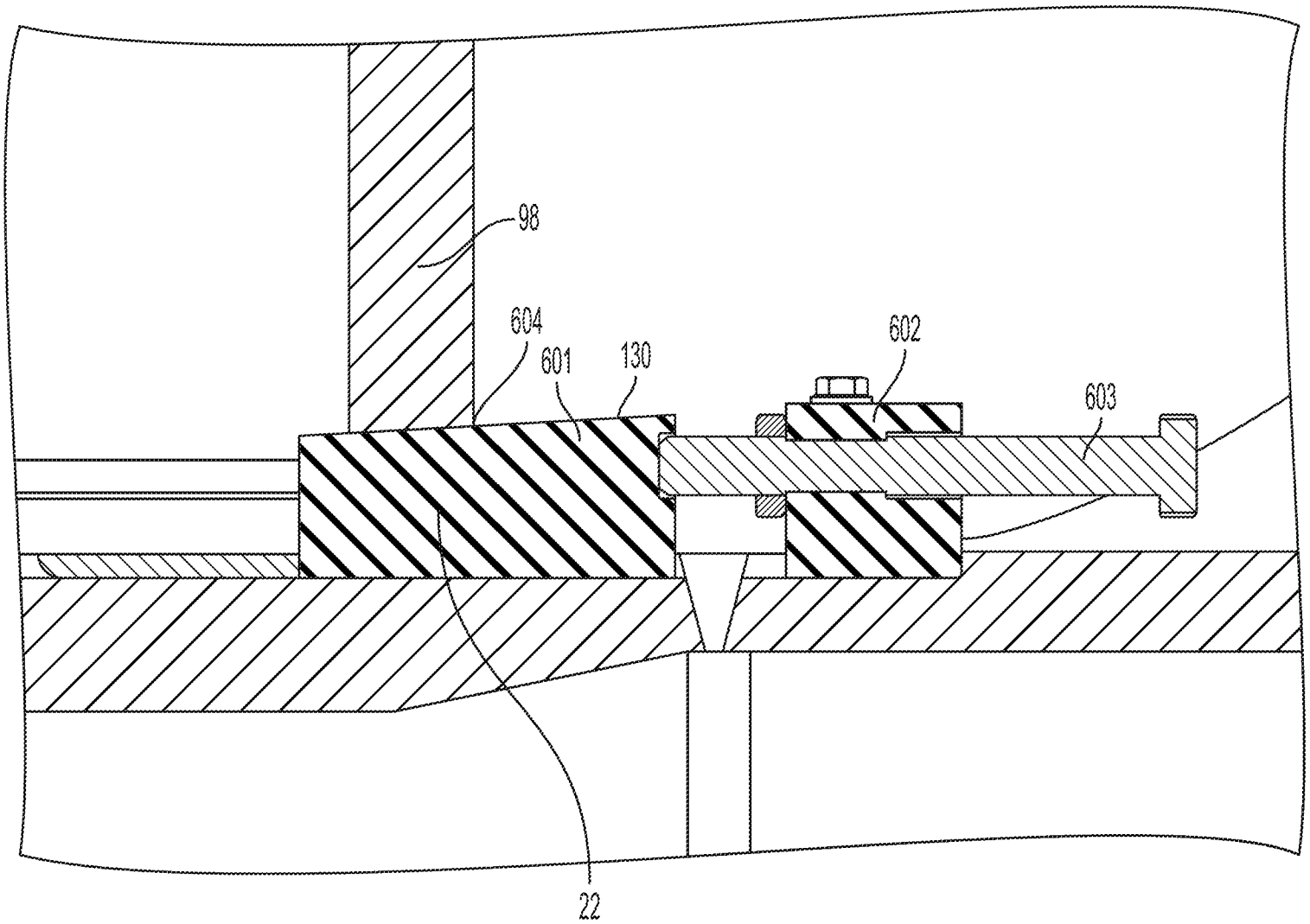

FIGS. 7A and 7B illustrate the operation of the wedge 130 as shown in FIG. 6. The wedge 130 is shown as a threaded pin wedge block and includes a wedge portion 601, a block 602, and a threaded adjustment or pin 603. In the illustrated embodiment, the block 602 is fixed to the rotating frame 22 (for example, the block 602 may be bolted to the rotating frame 22). One or more threaded pins 603 are configured to pass through and engage the block 602 and to extend into the wedge portion 601. The threaded pins 603 may be turned (i.e., threaded into or out of the block 602) to move the wedge portion 601 toward and away from the second end 98. Movement of the wedge portion 601 adjusts a gap 604 (i.e., a clearance) between the second end 98 and the wedge portion 601. For example, FIG. 7A illustrates the wedge portion 601 in a retracted position (e.g., creating a gap 604 of about 1.57 mm), and FIG. 7B illustrates the wedge portion 601 in an inserted position (e.g., creating a gap 604 of about 0 mm). In some embodiments, the gap 604 size may be adjusted to correspond to an anticipated maximum deflection of the rotating frame 22.

Figure 8:
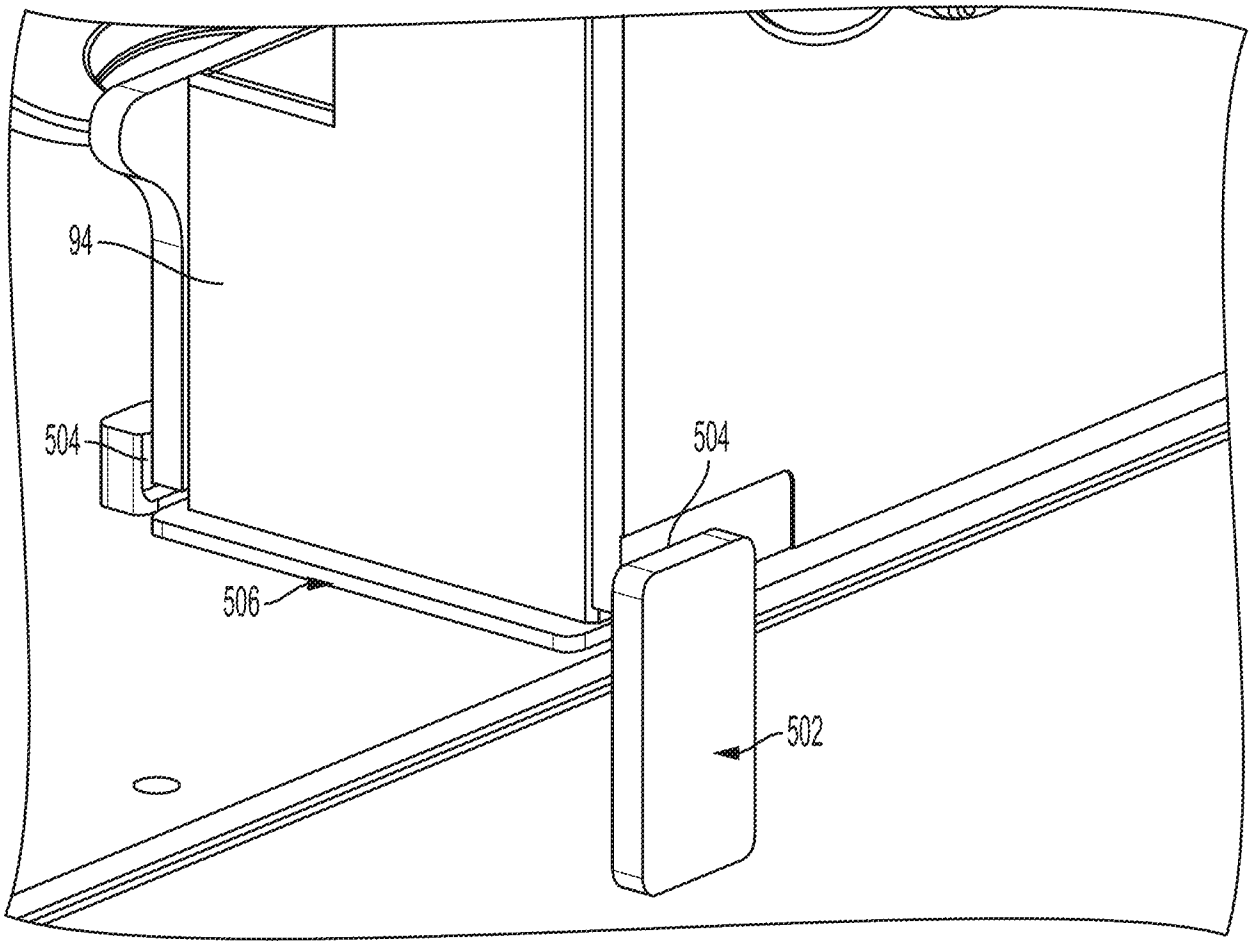
FIG. 8 is a support system for a hoist system gear case according to yet another embodiment.

FIG. 8 illustrates a system for supporting the gear case 90 according to yet another embodiment. In particular, the gear case second end (not shown) is coupled to the rotating frame 22 by a pin, while the first end 94 is permitted to slide in a direction parallel to the longitudinal axis of the gear case 90 extending between the first end 94 and the second end 98 (e.g., in a forward and rearward direction). In the illustrated embodiment, the first end 94 is supported for sliding movement by a pad 506 formed from a dissimilar material. In addition, a retainer or block 502 provides horizontal stop surfaces 504 to inhibit the gear case 90 from moving or pivoting away from the desired plane.

Figure 9:
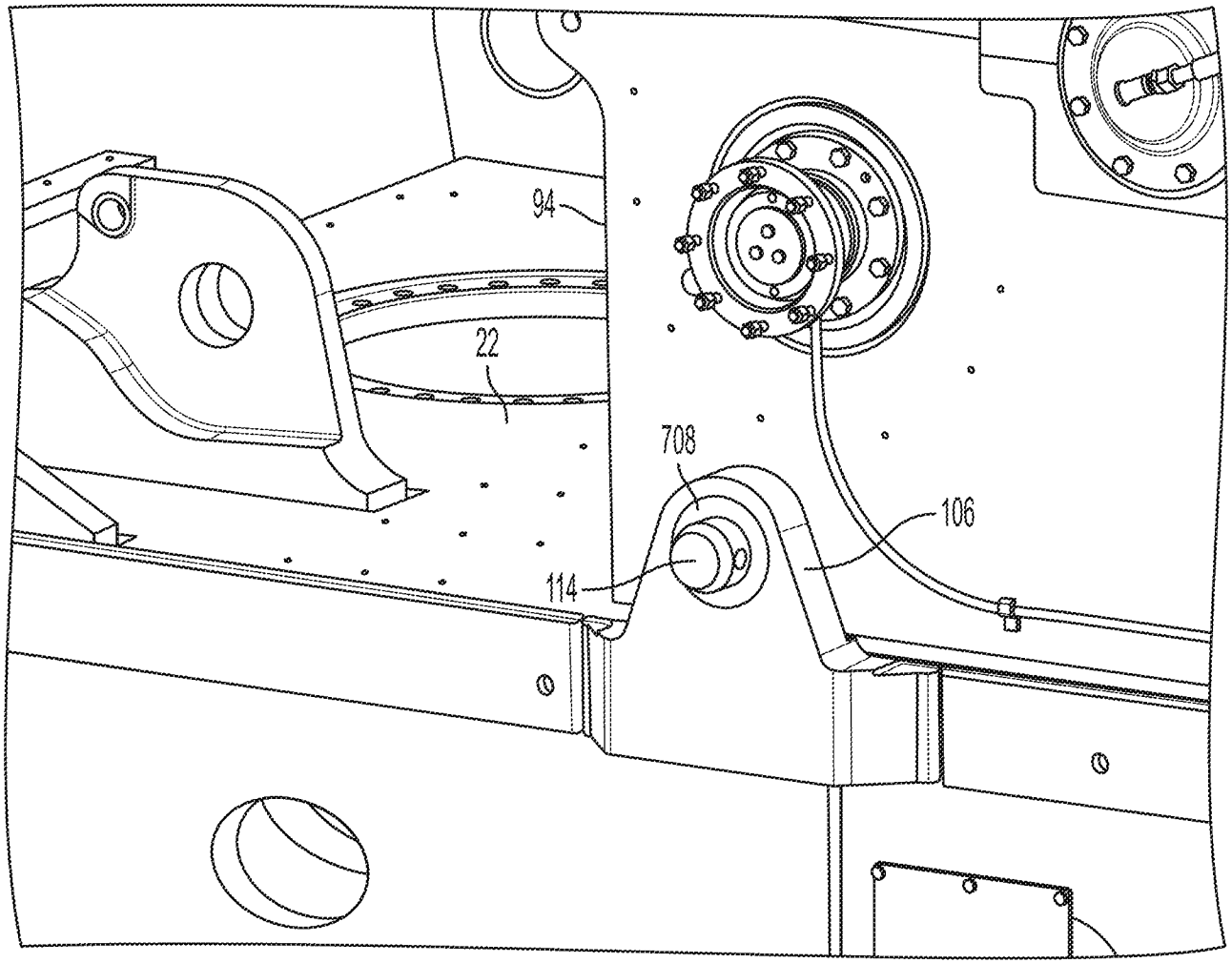
FIG. 9 is a support system for a hoist system gear case according to still another embodiment.

FIG. 9 illustrates a system for supporting the gear case 90 according to yet another embodiment. In particular, a bushing 708 is positioned between the first pin 114 and the first lug 106 to reduce stress in the pin joint while the rotating frame 22 flexes. In some embodiments, the bushing 708 may be made from a urethane material. In other embodiments, the bushing is a metal clad elastomer bushing. The bushing 708 is flexible to permit some movement/deflection of the first pin 114 in a direction parallel to the longitudinal axis, without inducing excessive longitudinal load into the gear case 90 or rotating frame 22 as the frame 22 flexes while also being sufficiently stiff to support the vertical load. In some embodiments, the bushing 708 may have a different stiffness in a first direction (i.e., the horizontal direction) compared to a stiffness in a second direction (i.e., the vertical direction).

Figure 10:
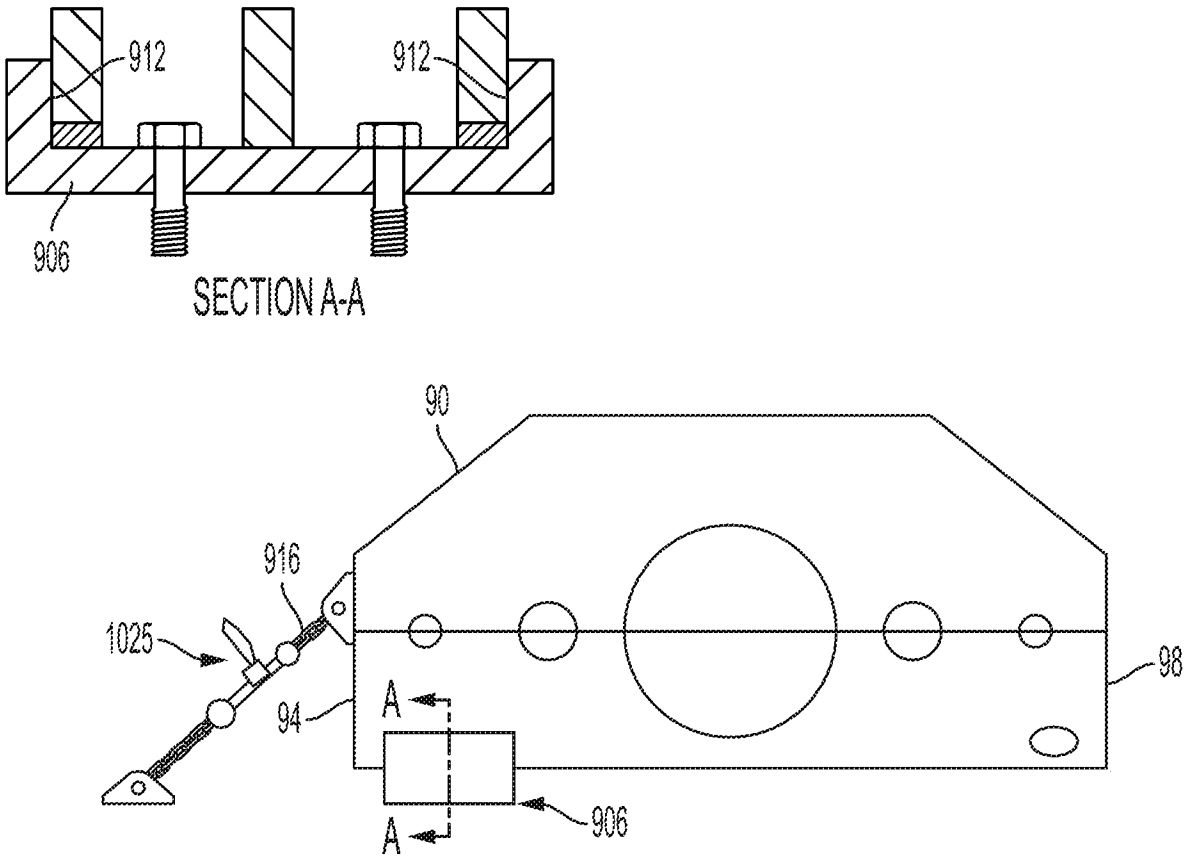
FIG. 10 is a support system for a hoist system gear case according to yet another embodiment.

FIG. 10 illustrates a system for supporting the gear case 90 according to yet another embodiment. In particular, the gear case second end is coupled to the rotating frame 22 by a pin, while the first end 94 is permitted to slide in a direction parallel to the longitudinal axis of the gear case 90 extending between the first end 94 and the second end 98 (e.g., in a forward and rearward direction). In the illustrated embodiment, the first end 94 is supported for sliding movement by a pad 906 formed from a dissimilar material (e.g., bronze, nylon, hardened steel, etc.). Dissimilar materials can be used to reduce friction at the interface and reduce the amount of wear in the joint. Additionally, the joint can be lubricated or coated. In addition, the pad 906 provides horizontal stop surfaces 912 to inhibit the gear case 90 from moving or pivoting away from the desired plane. Furthermore, a tether such as a chain 916 including a ratchet load binder 1025 is coupled between the rotating frame 22 and the first end 94 of the gear case 90 to bias the gear case 90 against the rotating frame 22 and limit vibrations.

Figure 11:
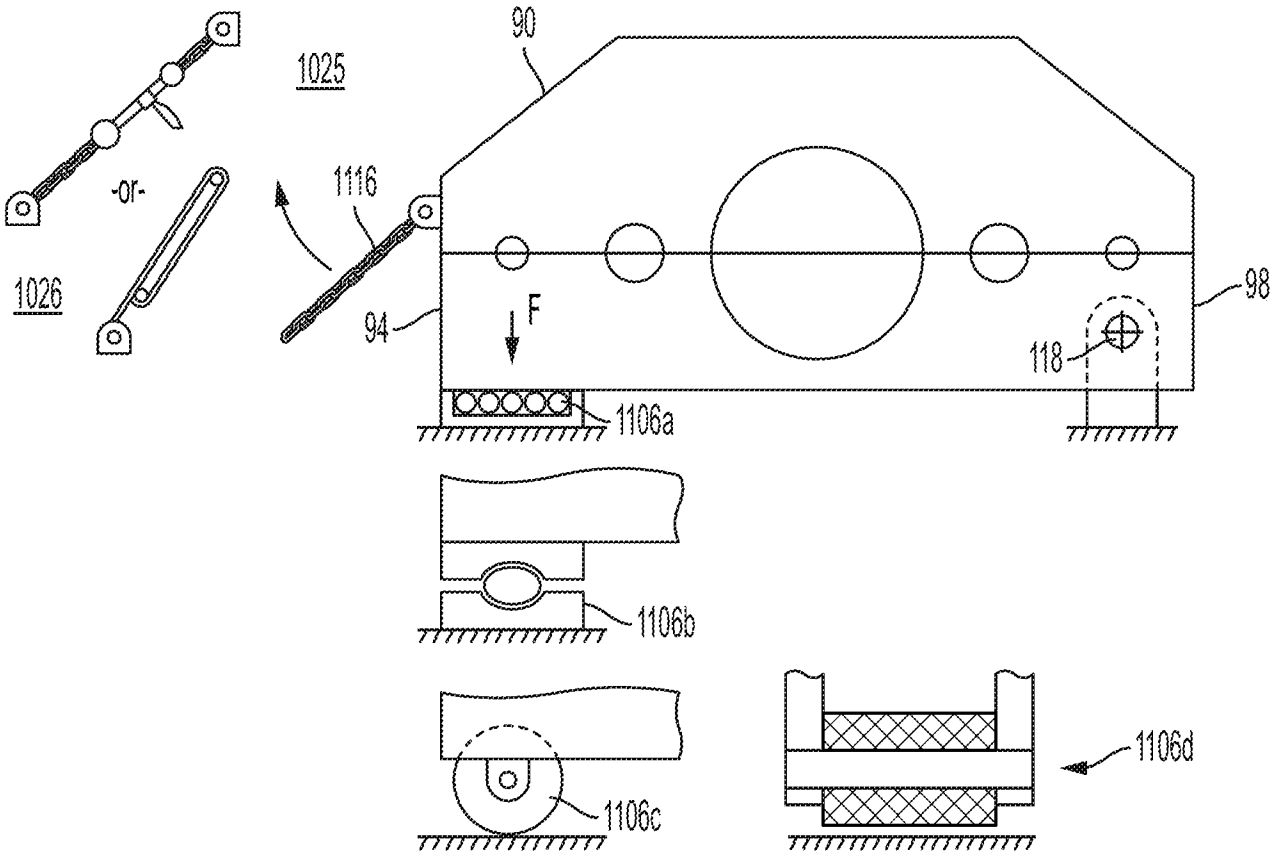
FIG. 11 is a support system for a hoist system gear case according to still another embodiment.

FIG. 11 illustrates a system for supporting the gear case 90 according to yet another embodiment. In particular, the gear case second end is coupled to the rotating frame 22 by a pin 118, while the first end 94 is permitted to move in a direction parallel to the longitudinal axis of the gear case 90 extending between the first end 94 and the second end 98 (e.g., in a forward and rearward direction relative to the excavation machine or the shovel 10). In the illustrated embodiment, the first end 94 is supported for movement by a roller element 1106. For example, the roller element 1106 may include a roller element bearing (1106*a*), a bridge bearing (1106*b*), and/or a cylindrical roller (1106*c*). Alternatively, the roller element 1106 may be replaced by a sliding contact pad (1106*d*). Furthermore, a tether such as a chain 1116 including a ratchet load binder 1025 is coupled between the rotating frame 22 and the first end 94 of the gear case 90. In other embodiments, another type of tensioning member (e.g., a fastener similar to the rod bolt 126 or a cable 1026) may be coupled between the rotating frame 22 and the first end 94 of the gear case 90.

Figure 12:
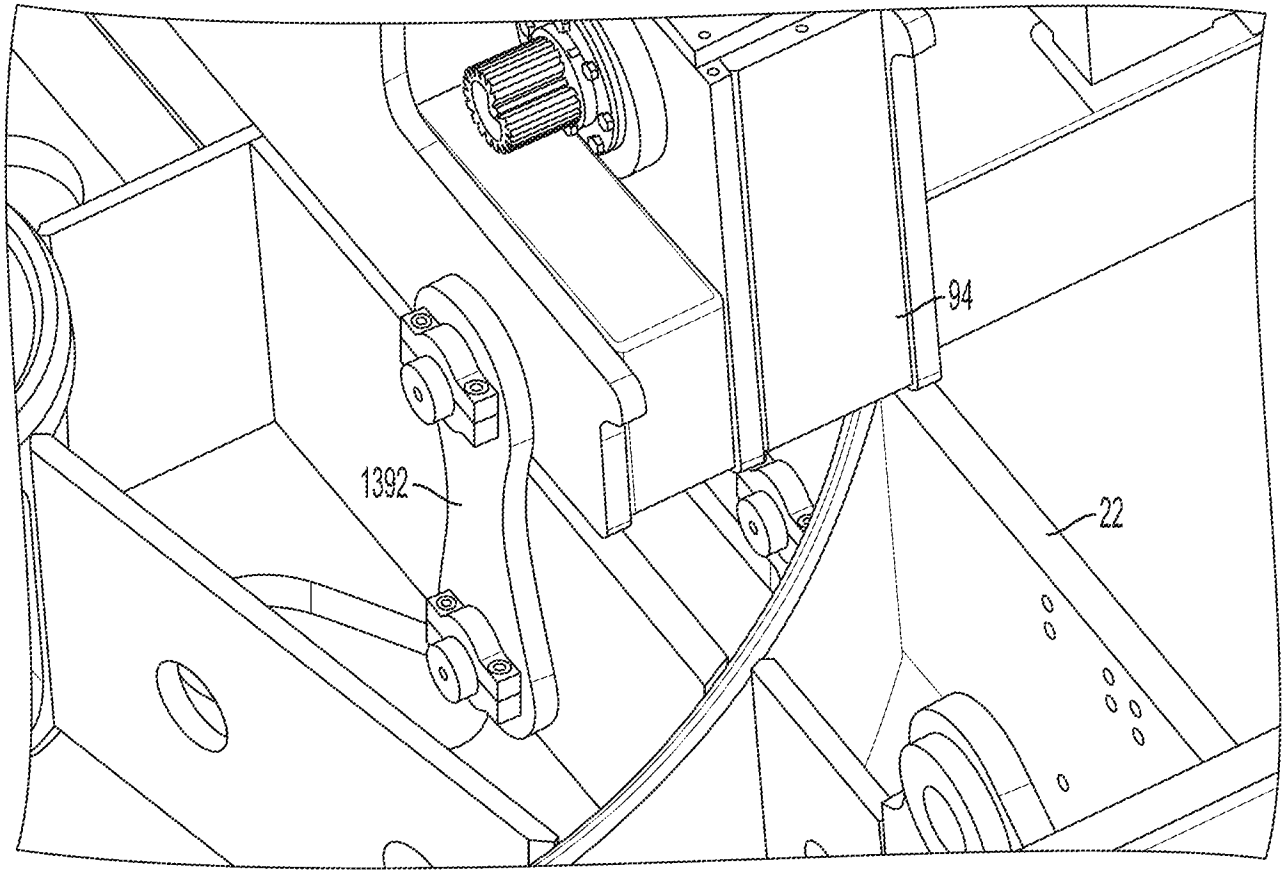
FIG. 12 is a support system for a hoist system gear case according to yet another embodiment.

FIG. 12 illustrates a system for supporting the gear case 90 according to yet another embodiment. In particular, the gear case 90 is coupled to the rotating frame by one or more planar links or bars 1392. Each link bar 1392 is pinned to the gear case 90 at one end and is pinned to the rotating frame 22 at another end, providing pivoting connections on each end of the link bar 1392 to permit movement of the gear case 90 in response to flexion of the rotating frame 22 during operation. FIG. 12 illustrates the first end 94 of the gear case 90, and the second end (not shown) can be coupled to the rotating frame 22 by a pin similar to pin 118 in FIG. 11. It is understood that other embodiments may include link bars coupled between the second end of the gear case 90 and the rotating frame with a pin coupling between the first end 94 and the rotating frame 22.

Figure 13:
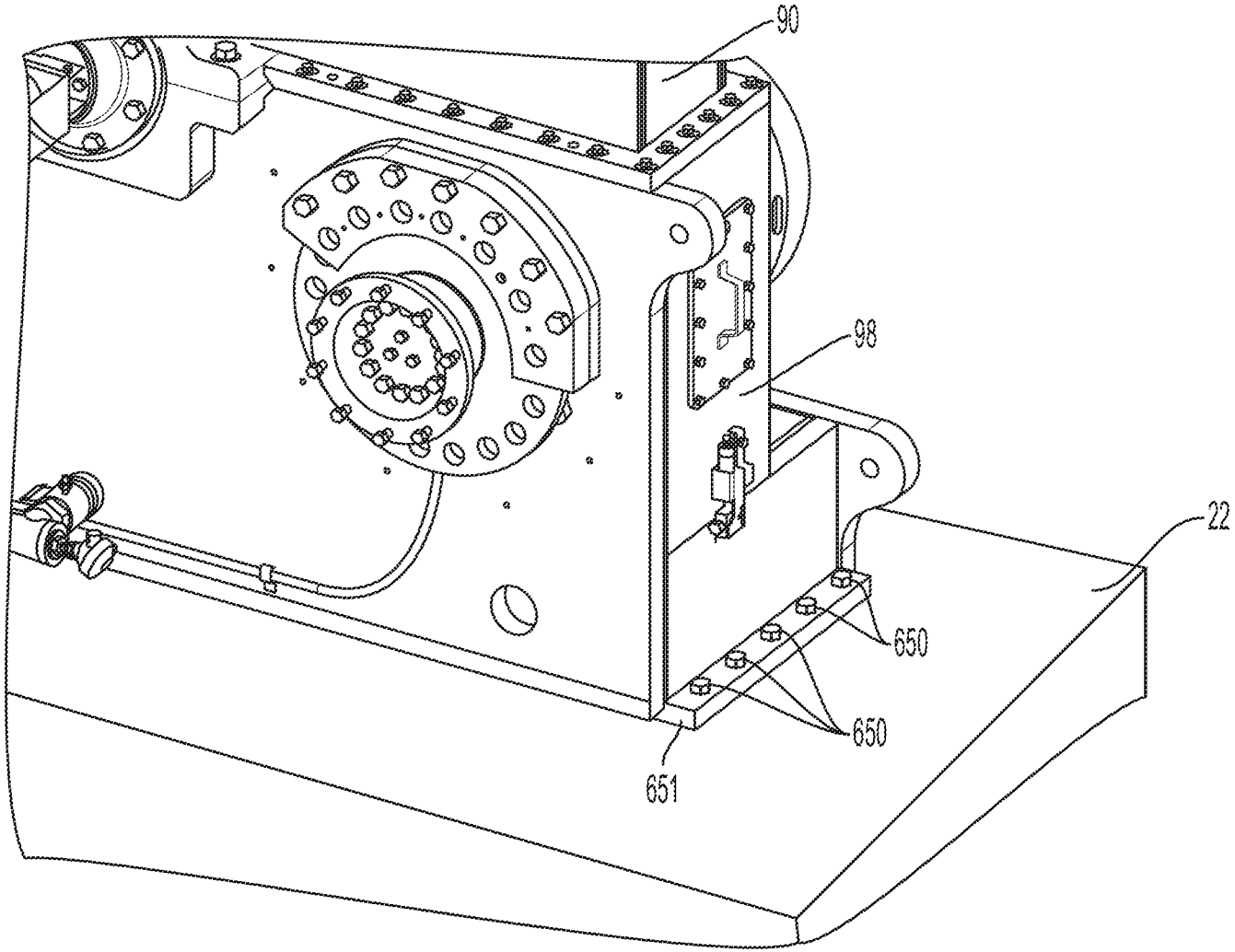
FIG. 13 is a support system for a hoist system gear case according to still another embodiment.

FIG. 13 illustrates a system for supporting the gear case 90 according to yet another embodiment. In particular, the gear case 90 is coupled to the rotating frame 22 by one or more bolts 650. In the illustrated embodiment, an attachment plate 651 is coupled to the second end 98 of the gear case 90, and the bolts 650 extend through the attachment plate 651 and into the rotating frame 22. The embodiment of FIG. 13 illustrates five bolts 650, although fewer or more bolts may be used in other embodiments.

Figure 14B:
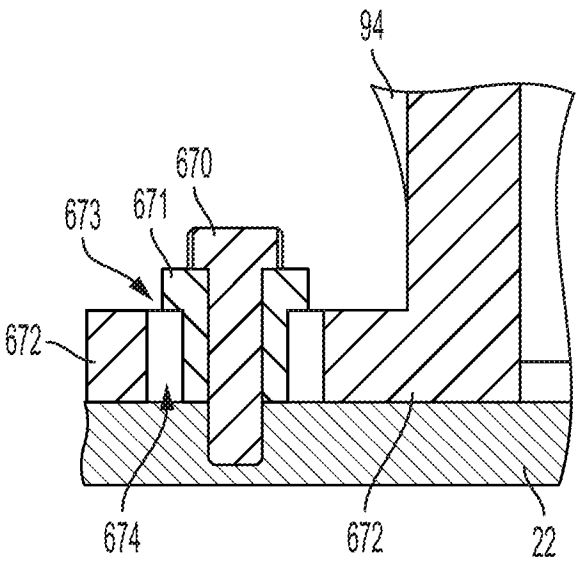
FIG. 14B illustrates a cross-sectional view of the support system of FIG. 14A.
Figure 14A:
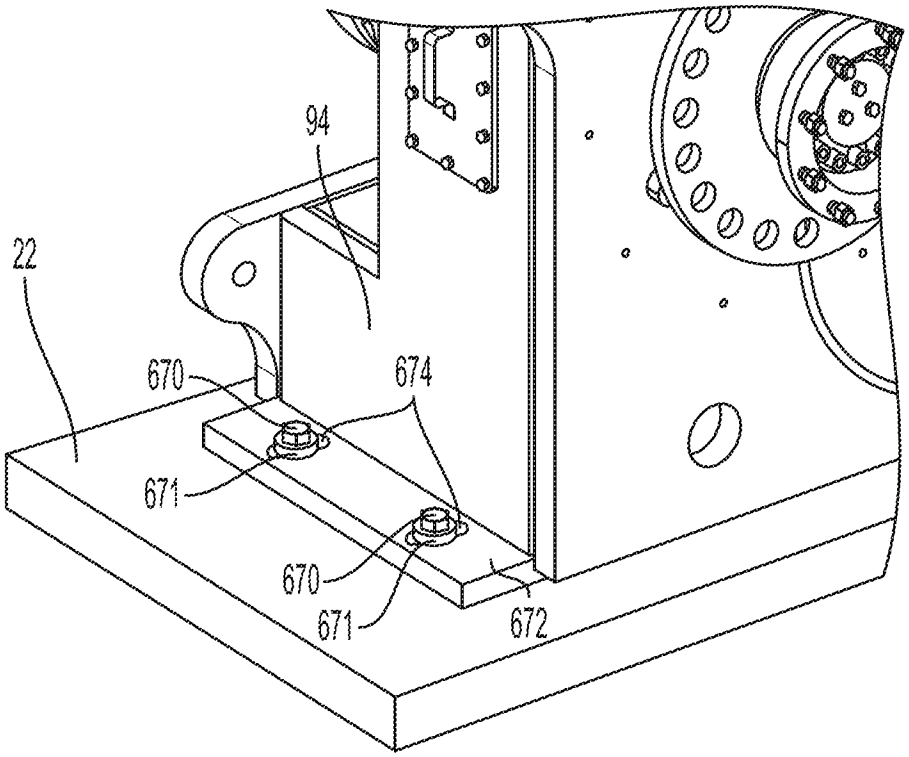

FIGS. 14A and 14B illustrate a system for supporting the gear case 90 according to yet another embodiment. In particular, the gear case 90 is coupled to the rotating frame 22 by one or more bolts 670. An attachment plate 672 is coupled to the first end 94 of the gear case 90, and the bolts 670 extend through the attachment plate 672 and attach to the rotating frame 22. The embodiment of FIG. 14A illustrates two bolts 670, although fewer or more bolts may be used in other embodiments. A bushing 671 is positioned between the attachment plate 672 and an associated one of the bolts 670. Stated another way, each bolt 670 is inserted through the bushing 671, and the bushing 671 and bolt 670 assembly is inserted through a slot 674 extending through the attachment plate 671.

FIG. 14B illustrates the slot 674, the bushing 671, and the bolt 670. In some embodiments, the slot 674 may be non-circular; for example, in the illustrated embodiment the slot has an oval shape, which creates a gap 673 between the circular bushing 671 and the inners surface of the slot 647. The gap 673 may allow for greater deflection of the bolt 670 and bushing 671 assembly in a first direction than a second direction. For example, as shown in FIG. 14A, the semi-major axis of the oval slot 674 extends beyond the upper, larger diameter portion of the bushing 671 (when viewed from above the bolt 670) along a direction perpendicular to the first end 94. Conversely, the oval gap 673 does not extend beyond the upper, larger diameter portion of the bushing 671 along a direction parallel to the first end 94 (i.e., along the semi-minor axis of the oval slot 674).

Similar to the bushing shown in FIG. 9, the bushing of FIGS. 14A and 14B is provided to reduce stress in the bolt 670 while the rotating frame 22 flexes. In some embodiments, the bushing 671 may be made from a urethane material. In other embodiments, the bushing is a metal clad elastomer bushing. The bushing 671 is flexible to permit some movement/deflection of the bolt 670 in a direction parallel to the longitudinal axis of the bolt 670, without inducing excessive longitudinal load into the gear case 90 or rotating frame 22 as the frame 22 flexes while also being sufficiently stiff to support the vertical load. In some embodiments, the bushing 671 may have a different stiffness in a first direction (i.e., the horizontal direction) compared to a stiffness in a second direction (i.e., the vertical direction).

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A support system for a gear case of a rope shovel, the gear case supporting a gear drive configured to drive rotation of a hoist drum, the gear case including a first end, a second end, and a longitudinal axis extending between the first end and the second end, the support system comprising:

a coupling for securing the gear case against translational movement relative to a rotating frame of the rope shovel, the coupling oriented orthogonally relative to the longitudinal axis and configured to engage the rotating frame and a portion of the gear case; and a support member configured to be coupled to the rotating frame and supporting the gear case, the support member permitting translational movement of the gear case relative to the rotating frame to accommodate flexing of the rotating frame.

2. The support system of claim 1, wherein the support member includes at least one of a pad configured to engage a lower surface of the gear case and support the gear case for sliding movement relative to the pad, a retainer extending in a direction perpendicular to the rotating frame and inhibiting movement of the gear case in an oblique direction with respect to the longitudinal axis, or a roller element configured to engage a portion of the gear case and support the gear case for rolling movement.

3. The support system of claim 1, wherein the support member includes a wedge configured to be positioned between a surface of the gear case and the rotating frame.

4. A support system for a gear case of a rope shovel, the gear case supporting a gear drive configured to drive rotation of a hoist drum, the gear case including a first end, a second end, and a longitudinal axis extending between the first end and the second end, the support system comprising:

a first coupling configured to be coupled between a rotating frame of the rope shovel and the first end of the gear case, the first coupling inhibiting movement of the gear case in a direction that is parallel to the longitudinal axis and inhibiting movement of the gear case in a direction that is perpendicular to the longitudinal axis; and a second coupling configured to be coupled between the rotating frame and the second end of the gear case, the second coupling inhibiting movement of the gear case in a direction that is perpendicular to the longitudinal axis while permitting movement of the gear case relative to the rotating frame in a direction parallel to the longitudinal axis to accommodate flexing of the rotating frame.

5. The support system of claim 4, wherein the second coupling is a pin oriented transverse to the longitudinal axis, the second coupling further including a resilient bushing positioned around the pin, the resilient bushing being deformable to permit movement of the gear case relative to the rotating frame.

6. The support system of claim 5, wherein the resilient bushing has a first stiffness in a first direction, and a second stiffness in a second direction.

7. The support system of claim 4, wherein the first coupling includes a pin oriented transverse to the longitudinal axis.

8. The support system of claim 4, wherein the first coupling includes a threaded member configured to be coupled between the gear case and the rotating frame, the threaded member exerting a clamping force in a direction substantially perpendicular to the longitudinal axis.

9. The support system of claim 4, further comprising an elongated member including a first end configured to be coupled to the gear case and a second end configured to be coupled to the rotating frame, the elongated member including one of a tether and a bar.

10. The support system of claim 4, further comprising a wedge configured to be positioned between a surface of the gear case and the rotating frame.

11. A transmission system for driving a hoist drum of a rope shovel, the transmission system comprising:

a housing having a first end, a second end, and a longitudinal axis extending therebetween;

a plurality of gears supported within the housing, the gears transmitting a driving torque to the hoist drum to rotate the hoist drum; and structure for supporting the housing relative to a rotating frame of the rope shovel, the structure including:

a coupling between the rotating frame of the rope shovel and the housing, the coupling inhibiting translational movement of the housing in a direction parallel to the longitudinal axis, and a translating connection engaging a portion of the housing and supporting the housing for translational movement along the longitudinal axis.

12. The transmission system of claim 11, wherein the translating connection includes a pad configured to engage a lower surface of the housing and support the housing for sliding movement relative to the pad.

13. The transmission system of claim 11, wherein the structure further includes a retainer extending in a direction perpendicular to the rotating frame and inhibiting movement of the housing in an oblique direction with respect to the longitudinal axis.

14. The transmission system of claim 11, wherein the translating connection includes a roller element configured to engage a portion of the housing and support the transmission system for rolling movement.

15. The transmission system of claim 11, wherein the translating connection includes an attachment plate, the attachment plate including slots having a semi-major axis oriented parallel to the longitudinal direction, the attachment plate being bolted to the rotating frame via bolts extending through the slots such that the second end of the housing translates along the longitudinal axis in response to rotational movement of the hoist drum.

16. The transmission system of claim 11, wherein the structure further includes a tether for coupling one of the first end and the second end of the housing to the rotating frame.

17. The transmission system of claim 11, wherein the structure includes a threaded member configured to be coupled between the gear case and the rotating frame, the threaded member exerting a clamping force in a direction substantially perpendicular to the longitudinal axis.

18. The transmission system of claim 11, further comprising a wedge configured to be positioned between a surface of the gear case and the rotating frame.

19. The support system of claim 1, further comprising the rotating frame, wherein the rotating frame includes a first lug, wherein the coupling includes a first pin configured to extend through the first lug of the rotating frame and through the gear case, wherein a clearance is provided around the first pin to accommodate a flexing movement of the rotating frame, wherein the support system further includes a second lug extending from the rotating frame and a second pin configured to extend through the second lug of the rotating frame and through the gear case, and wherein a clearance is provided around the second pin to accommodate the flexing movement of the rotating frame.

20. The support system of claim 19, further comprising a tensioning member configured to apply a clamping force in a direction substantially normal to the rotating frame, and configured to bias the first end of the gear case toward the rotating frame.

21. A support system for a gear case of a rope shovel, the gear case supporting a gear drive configured to drive rotation of a hoist drum, the gear case including a first end, a second end, and a longitudinal axis extending between the first end and the second end, the support system comprising:

a first lug extending from a rotating frame; and a first pin configured to extend through the first lug of the rotating frame and through the gear case along a direction orthogonal to the longitudinal axis, a clearance being provided around the first pin to accommodate a flexing movement of the rotating frame.

* * * * *